US005350275A

United States Patent [19]

Ishimaru

[11] Patent Number: 5,350,275

[45] Date of Patent: Sep. 27, 1994

[54] TURBOMOLECULAR PUMP HAVING VANES WITH CERAMIC AND METALLIC SURFACES

[75] Inventor: Hajime Ishimaru, Tsukuba, Japan

[73] Assignee: Zaidan Houjin Shinku Kagaku Kenkyujo, Japan

[21] Appl. No.: 71,571

[22] Filed: Jun. 3, 1993

[30] Foreign Application Priority Data

Jun. 5, 1992 [JP] Japan ..... 4-171768

[51] Int. Cl.[5] ..... F01D 1/36

[52] U.S. Cl. ..... 415/90; 415/200; 415/217.1; 416/241 B; 417/423.4; 417/423.8

[58] Field of Search ..... 415/90, 200, 177, 199.5, 415/216.1, 217.1; 416/241 B; 417/423.4, 423.8

[56] References Cited

U.S. PATENT DOCUMENTS 2,308,233 1/1943 Schütte ..... 416/241 B
4,108,620 8/1978 Bohme et al. ..... 417/420
5,074,747 12/1991 Ikegami et al. ..... 415/90

FOREIGN PATENT DOCUMENTS 0046394 3/1984 Japan ..... 415/90
0230989 9/1988 Japan ..... 415/90

*Primary Examiner*—Edward K. Look
*Assistant Examiner*—Christopher Verdier
*Attorney, Agent, or Firm*—Bruce L. Adams; Van C. Wilks

[57] ABSTRACT

A turbomolecular pump comprises a casing having an inlet port at one end portion and an outlet port at another end portion, a rotor supported rotatably within the casing, and a stator fixed on an inner wall of the casing. The rotor has rotor vanes which coact with stator vanes on the stator to pump gas molecules from the inlet port to the outlet port. The rotor and stator vanes are arranged in multi-steps and have ceramic surfaces at the steps near the outlet port of the casing and have metallic surface at all other steps, so as to promote the baking efficiency and obtain extremely high vacuums.

12 Claims, 3 Drawing Sheets

TURBOMOLECULAR PUMP HAVING VANES WITH CERAMIC AND METALLIC SURFACES

BACKGROUND OF THE INVENTION

The present invention relates to a turbomolecular pump having a magnetic bearing system to be used for pumping to high vacuum and especially relates to a turbomolecular pump adaptable for extremely high vacuum pumping by promoting an efficiency of heat transfer due to heat radiation from a rotor of the pump.

A conventional turbomolecular pump has a casing provided with an inlet port at one end portion and an outlet port at the other end thereof and also has a rotor supported by magnetic bearings floatingly in the casing. The rotor has rotor vanes arranged axially therealong in multi-steps. Furthermore a stator is provided in the casing, and the stator has stator vanes inserted between the rotor vanes with very small gaps therebetween in such a way that the stator vanes are fixed by spacer rings on an inner wall of the casing. A motor is provided coaxially with the rotor for driving the rotor rotationally in the casing and a number of revolution of the motor is measured by a sensor.

When using such a conventional turbomolecular pump having a magnetic bearing system of the structure stated above, the rotor rotates in a condition of completely floating in the vacuum environment during the outgassing operation. Namely, the rotor is floating in a status of non-contact with the casing and the stator in the vacuum.

There are, however, some problems with the above conventional turbomolecular pump having a magnetic bearing system.

Since the rotor is floating in a condition of completely non-contact with a casing or a stator, an efficiency of heat transfer between the rotor and the neighboring elements is low. Namely, there is no heat transfer by heat conduction, because the rotor does not contact the casing and the stator, and there is no heat transfer by heat convection, because the rotor is in an ultra vacuum environment and in non-contact status with the casing and the stator. Consequently, heat transfer is performed only by heat radiation. The rotor, in general, is made of aluminum alloy, and the stator vanes and the spacer rings mounted for fixing the stator vanes are also made of aluminum alloy. This aluminum alloy has low emissivity, that is 0.04 approximately, and stainless steel which is used frequently as a structural material for vacuum apparatus has about 0.4 of emissivity. Accordingly, even by radiation, a high efficiency of heat transfer would not be much expected.

Further, when carrying out a baking treatment by using a heater outside of the casing for removing gases adsorped to the surface of the rotor, the temperature of the rotor cannot reach a sufficient baking temperature because of less heat exchange between the rotor and the casing or the stator.

Moreover, during operation of the rotor, there is a phenomenon of heat generation due to eddy current loss in the motor, and also another phenomenon of heat generation due to eddy current loss in the magnetic circuit dynamically controlling the magnetic bearings which support the rotor.

On the other hand, the rotor during operation exists in an idealistic adiabatic condition of no heat conduction and no heat convection as well as very small heat radiation due to the aluminum alloy having a very small emissivity, and also the rotor exists in a non-contact condition at the bearing portions. Therefore, the temperature of the rotor is raised to very high degree by heat generation at the rotor where the operation temperature should be kept 50°~70° C., so that the extremely high vacuum can not be realized because of outgassing from the rotor.

SUMMARY OF THE INVENTION

The object of the present invention is to provide a turbomolecular pump which promotes the efficiency of baking and cooling the rotor by improving heat transfer in such a way that the both surfaces of both the rotor vanes near the outlet port and stator vanes opposite to the rotor vanes are ceramic surfaces having large heat emissivity.

In order to achieve the above object, in a turbomolecular pump of the present invention, the turbomolecular pump comprises a casing having an inlet port at the one end portion and an outlet port at the other end portion, a rotor having rotor vanes defining multi-steps and being supported within the casing rotatably, a stator having stator vanes inserted between the rotor vanes with very small gaps therebetween and being fixed on an inner wall of the casing, and a motor provided coaxially with the rotor so as to drive the rotor rotationally, and characterized in that both the rotor vanes and the stator vanes have a ceramic surface at the steps near the outlet port, and have a metallic surface at all the other steps.

In accordance with a further aspect of the present invention, the casing has a ceramic surface at a portion of its inner wall corresponding to the ceramic surface of the stator vanes.

Moreover, in a turbomolecular pump according to the present invention, the stator vanes are fitted through spacer rings which are engaged fixedly on the inner wall of the casing, and the spacer rings have a ceramic surface at a portion corresponding to where the stator vanes have a ceramic surface.

In another aspect of the present invention, respective numbers of steps of the rotor vanes and the stator vanes having ceramic surface constitute approximately 20~50% of all numbers of steps provided for the respective vanes.

Furthermore, in a turbomolecular pump according to the present invention, both the rotor vanes and the stator vanes are made of metal and coated with ceramics at the steps near the outlet port.

With the turbomolecular pump of the present invention as stated above, heat exchange can be carried out efficiently between the rotor vanes and the stator vanes at the steps near the outlet port by heat radiation, since both the rotor vanes and the stator vanes of the steps near the outlet port have ceramic surfaces. Therefore, the efficiency of thermal conductivity is promoted.

Furthermore, during operation of the present turbomolecular pump, a vacuum container connected to the inlet port of the pump is not be under bad influences due to lowering the pressure by outgassing, because both the rotor vanes and the stator vanes have metallic surfaces at the steps near the inlet port of the casing, namely they do not have ceramic surfaces which tend to cause outgassing.

Moreover, the spacer rings of the stator vanes and an inner wall of the casing have also ceramic surfaces corresponding to the portions having ceramic surface of the stator vanes, consequently, the heat transfer to the rotor when baking is carried out before using the turbomolecular pump and the removal of heat from the rotor during operation of the pump are performed further efficiently.

DETAILED DESCRIPTION OF THE INVENTION

Figure 1:
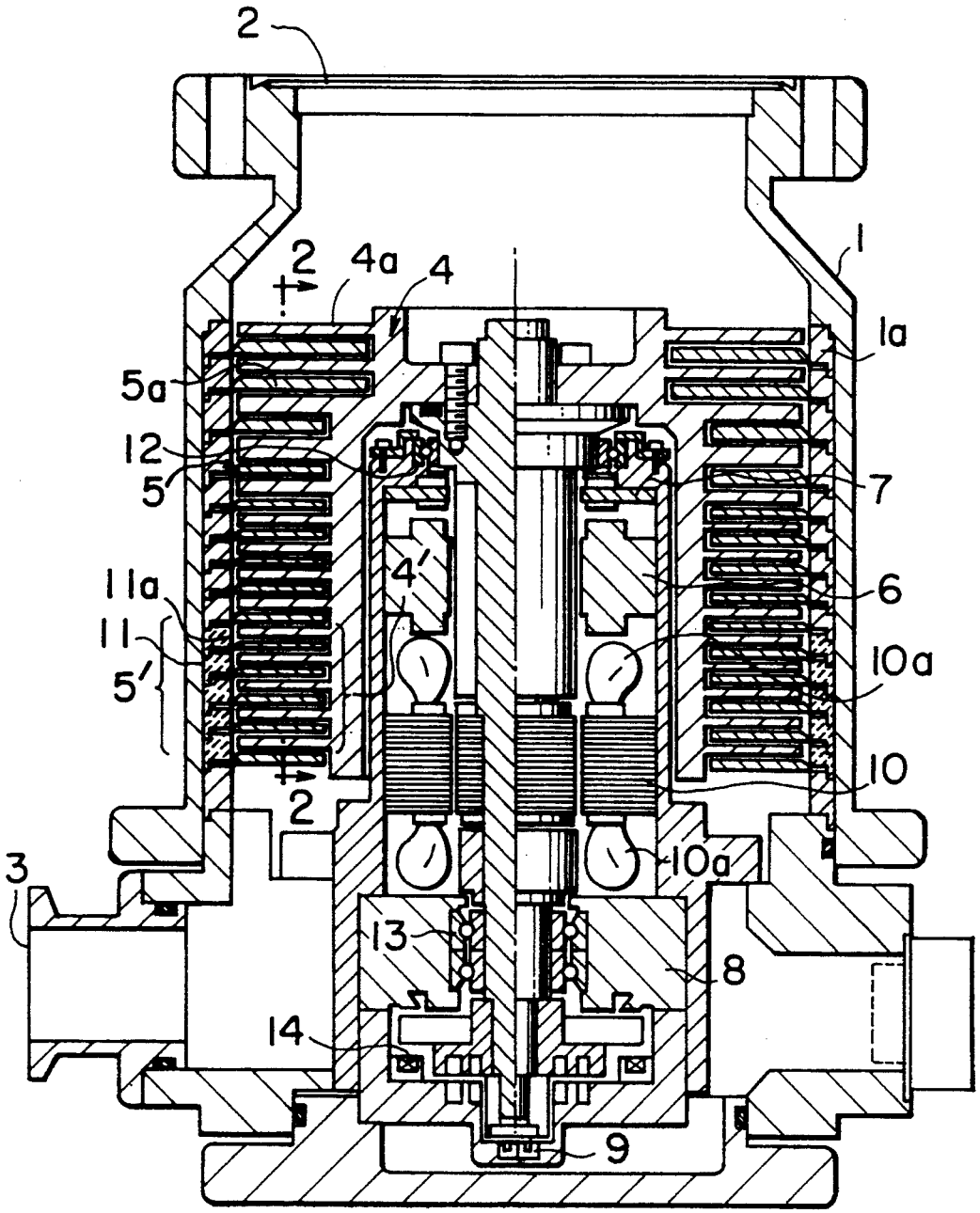
FIG. 1 is a partly sectional view showing a turbomolecular pump according to an embodiment of the present invention.
Figure 2:
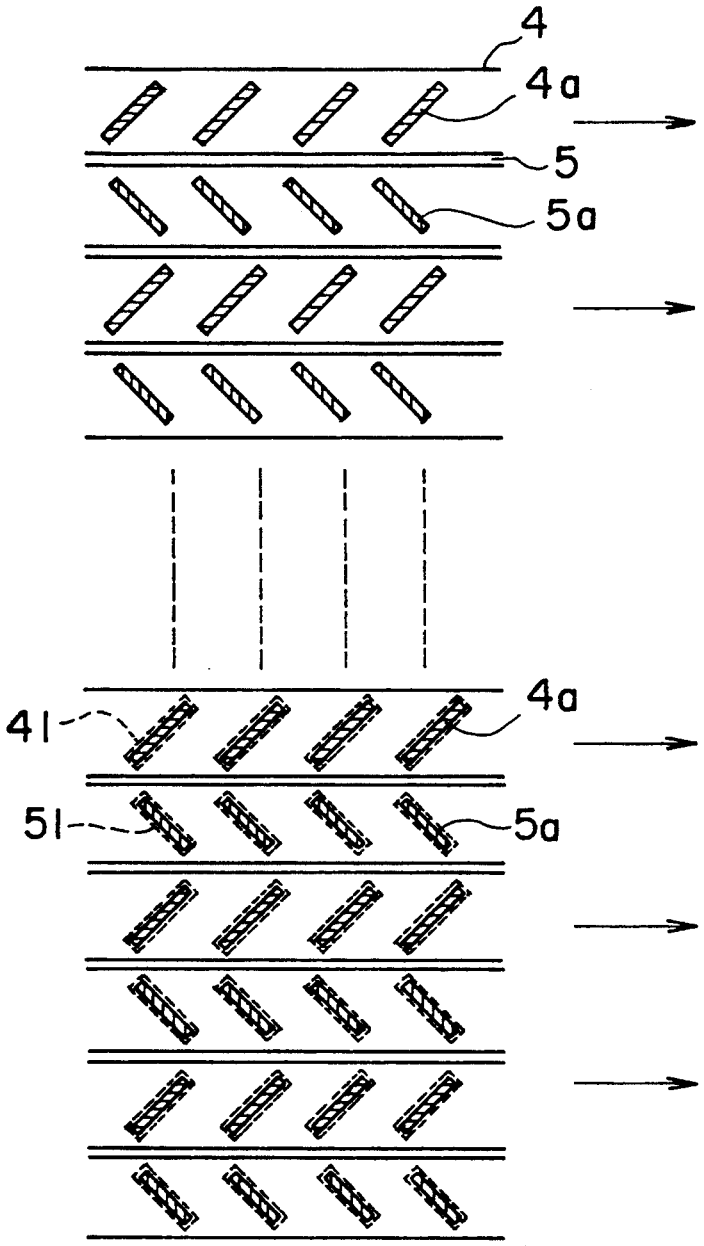
FIG. 2 is a cross sectional view of the rotor and stator vanes taken on line 2—2 in FIG. 1.
Figure 3:
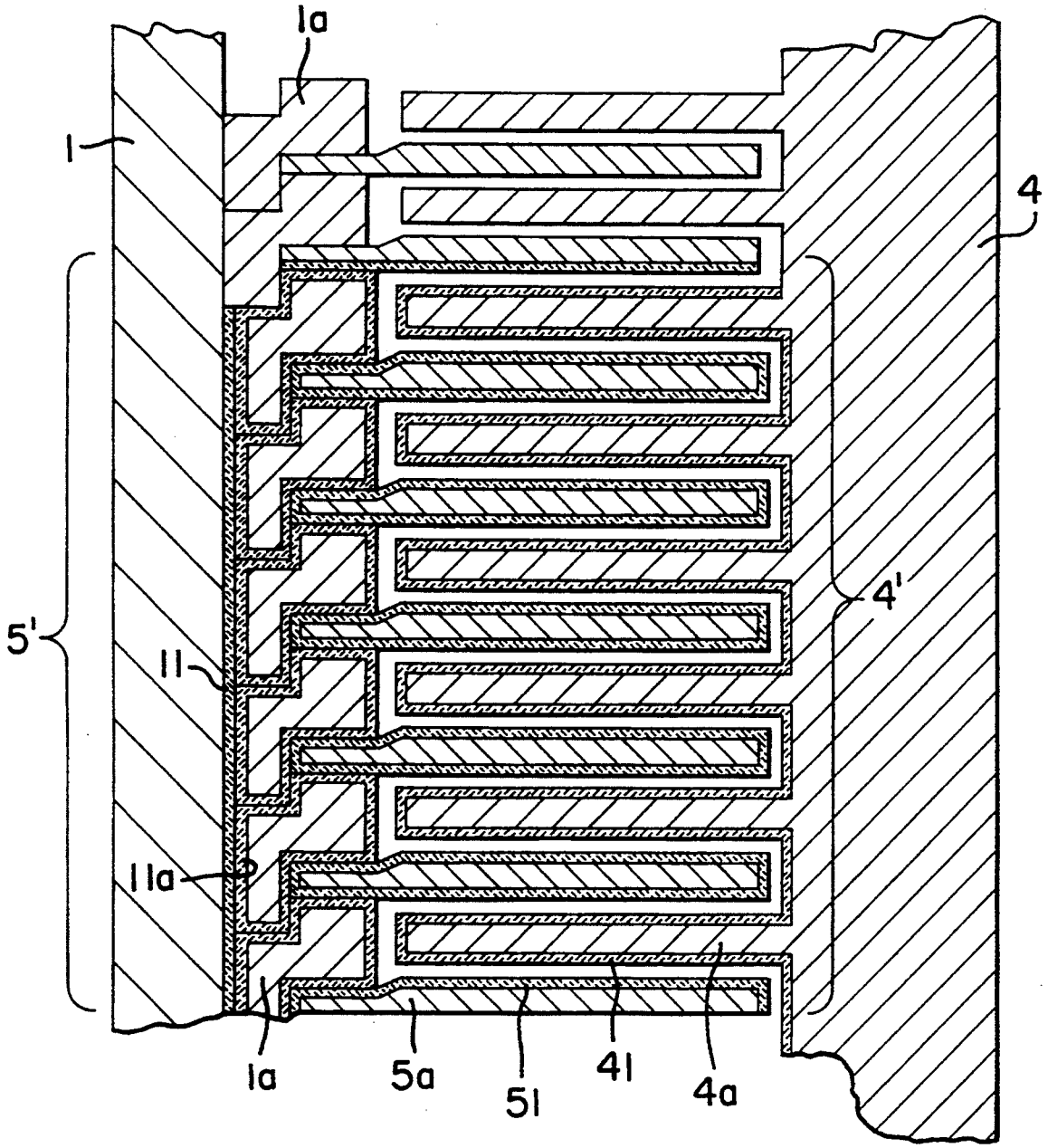
FIG. 3 is an enlarged view of the turbomolecular pump near the outlet.

Referring to FIGS. 1 and 2 in which a preferable embodiment of the present invention is shown, a turbomolecular pump comprises a casing 1 having an inlet port 2 at the inlet end portion and an outlet port 3 at the other end portion, and a rotor 4 magnetically supported by magnetic bearings (6, 8) in a floating condition in the casing 1. The rotor 4 has rotor vanes 4*a* in multi-steps. In the casing 1, there is provided a stator 5 comprising stator vanes 5*a* in multi-steps. The stator vanes 5*a* are respectively located between the rotor vanes 4*a* with a very small gap therebetween, and each stator vane 5*a* is fixed on an inner wall of the casing 1 by a spacer ring 1*a*. For driving the rotor 4, a motor 10 having coils 10*a* is installed coaxially with the rotor 4 in the casing, and the rotor 4 is driven controllably according to a detected signal from a revolution sensor, such as a tachometer 14.

Furthermore, in the turbomolecular pump according to the present invention, both the rotor vanes 4*a* and stator vanes 5*a* have ceramic surfaces (41, 51) respectively at the rotor vane portion 4' and the stator vane portion 5' near the outlet port 3. At the other portions of the rotor vanes 4*a* and the stator vanes 5*a*, their surfaces are all made of metal.

Generally, the rotor 4 and the stator 5 are made of aluminum alloy, while in the present invention, both the rotor vane portion 4' and the stator vane portion 5' which are made of aluminum alloy are covered with a ceramic coating selected from a group of materials such as $SiO_2$ or $Al_2O_3$ having high emissivity in the wavelength range of infrared ray. As for such ceramic coatings, material groups of molybdenum or tungsten can be used.

The rotor vane portion 4' and the stator vane portion 5' having the ceramic surface should be limited within about 20~50% of the total number of steps of the rotor vanes 4*a* and the stator vanes 5*a* near the outlet port 3 in order to avoid bad influences against vacuum characteristics, since an outgassing speed of such ceramic surface (41, 51) is high as compared with metal surfaces of aluminum alloy or the like.

In this embodiment, the casing 1 has a ceramic surface 11 at the inner wall of the casing 1 corresponding to the portion of the stator vanes 5*a* coated with a ceramic surface 51 as well as the spacer rings 1*a* have a ceramic surface 11*a* at the portion also corresponding to the stator vanes 5*a* coated with a ceramic surface 51.

As a modified embodiment, at least one of the rotor vanes 4*a* and the stator vanes 5*a* may be made of ceramics and then may be covered with metal surface at the portion near the inlet port 2, since such a metal surface has low outgassing.

In FIG. 1, the numeral 7 represents a sensor of radial direction for the magnetic bearing 6 and the numeral 9 represents a sensor of axial direction for the magnetic bearing 8. Both numerals 12 and 13 represent a dry bearing provided for protection.

In the turbomolecular pump having the structure as stated above according to the present invention, the following operations are performed and preferable effects are obtained.

When baking is carried out before using this turbomolecular pump, the casing 1 is heated from outside by a heater (not shown in Figures) at the temperature of about 120°~150° C., then the stator 5 and the spacer rings 1*a* in the casing 1 are heated by heat conduction and heat radiation at almost the same temperature of the casing 1 . At that time, the heat transfer by heat radiation can be carried out efficiently from the casing 1 to the stator vanes 5*a* through the spacer rings 1*a*, because the casing 1, spacer rings 1*a* and stator vanes 5*a* each have a ceramic surface (11, 11*a*, 51).

Then the rotor 4 heated by heat radiation from the stator 5. At the vane step portions 4' and 5' each having ceramic surface (41 , 51) on the rotor vanes 4*a* and the stator vanes 5*a*, the emissivity of the ceramic surface is large, for example, the value is 0.96 in the case of ceramic treatment of $SiO_2$, so that the heat exchange should be carried out sufficiently and a desired temperature for baking can be achieved. Namely, an efficiency of baking in the rotor 4 should be higher and the outgassing becomes lower so that ultra high vacuum conditions can be obtained.

When operating under ultra high vacuum conditions, heat generation due to eddy current loss occurs in the motor 10. At that time, the rotor 4 is in a floating condition by dynamic control due to the magnetic circuit of one axis or three or five axes. By such a magnetic control, an eddy current loss exists also in the magnetic circuit at the rotor 4, though it is a very little loss, and such eddy current loss results in heat generation. In this way, heretofore, temperature raising of the rotor 4 has occurred during operation for producing a vacuum.

On the contrary, according to the present invention, it should be possible to lower the temperature of the rotor 4 during operation because of effective cooling by heat transfer due to heat radiation between the rotor vane 4*a* and the stator vane 5*a* each having ceramic surface (41, 51). And since the casing 1 and the spacer rings 1*a* a have also ceramic surface (11, 11*a*) respectively, the heat transfer due to heat radiation from the rotor vanes 4*a* to the outside can be carried out sufficiently through the stator vanes 5*a*, the spacer rings 1*a* and the casing 1. Consequently, outgassing from the rotor 4 at the region of extremely high vacuum is prevented and the ultimate pressure becomes lower.

Moreover, even with a partial ceramic coating on the rotor 4 and stator 5 near the outlet port 3, the entire rotor 4 can be heated or cooled almost uniformly by heat conduction because the rotor 4 is made of aluminum alloy or the like integrally.

On the other hand, at the portion near the inlet port 2 of the casing 1, during operation of the present turbomolecular pump , the rotor vanes 4*a*, stator vanes 5*a*, spacer rings 1*a* and the inner wall of the casing 1 have metallic surfaces, namely they do not have ceramic surfaces which tend to cause outgassing. Consequently, the vacuum chamber connected to the inlet port 2 should not be under the bad influence due to lowering the pressure by outgassing.

Thus, it should be possible to provide a turbomolecular pump for extremely high vacuum of the order of $10^{-12}$ Torr by promoting the baking efficiency of the rotor 4 as well as by low outgassing during the operation.

In the embodiment as stated above, the rotor during its operation is supported in a floating condition by magnetic bearings. But this invention can be adopted also to the case where the rotor may be supported rotatably only by ball-bearings or fluid bearings.

As mentioned above in detail, a turbomolecular pump according to the present invention has the following effects or advantages.

(1) When baking, the temperature of the rotor can be raised by heat exchange due to heat radiation between the rotor vanes and the stator vanes each having a partially ceramic surface, so that the baking efficiency can be promoted.

(2) Since the spacer rings of the stator and the inner wall of the casing also have a partially ceramic surface respectively corresponding to the portion having ceramic surface of the stator vanes, the baking efficiency can be promoted.

(3) By lowering the temperature of the rotor during operation in extremely high vacuum conditions due to radiated cooling between the rotor vanes and the stator vanes each having ceramic surface partially, the outgassing from the rotor can be lowered. Furthermore, the spacer rings and the inner wall of the casing are also made so as to have a partially ceramic surface, therefore the heat from the rotor can be removed more efficiently.

(4) Since the rotor vanes and the stator vanes each having a ceramic surface are provided only at the vane step portions near the outlet port at which the casing and spacer rings each having a ceramic surface are also provided similarly, the achievement of extremely high vacuum is not disturbed by outgassing from the ceramic surface.

While the invention has been described in conjunction with a preferred specific embodiment thereof, it will be understood that this description is intended to illustrate and not limit the scope of the invention, which is defined by the following claims.

What is claimed is:

1. A turbomolecular pump comprising:

a casing having an inlet port at one end portion and an outlet port at another end portion, a rotor having rotor vanes in multi-steps and being supported rotatably within said casing, a stator having stator vanes in multi-steps and inserted between said rotor vanes with very small gaps therebetween and being fixed on an inner wall of said casing, and a motor extending coaxially with said rotor for rotationally driving said rotor;

wherein both said rotor vanes and said stator vanes have ceramic surfaces at the steps near said outlet port, and have metallic surfaces at all the other steps.

2. A turbomolecular pump according to claim 1, wherein said casing has a ceramic surface at a portion of its inner wall corresponding to the ceramic surfaces of said stator vanes.

3. A turbomolecular pump according to claim 1 or 2, wherein said stator vanes are fitted through spacer rings which are engaged fixedly on the inner wall of said casing, and said spacer rings have ceramic surfaces at a portion corresponding to the ceramic surfaces of said stator vanes.

4. A turbomolecular pump according to claim 3, wherein the numbers of said rotor vanes and said stator vanes having ceramic surfaces are approximately 20~50% of the total numbers of said rotor vanes and said stator vanes.

5. A turbomolecular pump according to claim 4, wherein both said rotor vanes and said stator vanes are made of metal and coated with ceramic material at the steps near said outlet port.

6. A turbomolecular pump according to claim 3, wherein both said rotor vanes and said stator vanes are made of metal and coated with ceramic material at the steps near said outlet port.

7. A turbomolecular pump according to claim 2, wherein the numbers of said rotor vanes and said stator vanes having ceramic surfaces are approximately 20~50% of the total numbers of said rotor vanes and said stator vanes.

8. A turbomolecular pump according to claim 7, wherein both said rotor vanes and said stator vanes are made of metal and coated with ceramic material at the steps near said outlet port.

9. A turbomolecular pump according to claim 2, wherein both said rotor vanes and said stator vanes are made of metal and coated with ceramic material at the steps near said outlet port.

10. A turbomolecular pump according to claim 1, wherein the numbers of said rotor vanes and said stator vanes having ceramic surfaces are approximately 20~50% of the total numbers of said rotor vanes and said stator vanes.

11. A turbomolecular pump according to claim 4, wherein both said rotor vanes and said stator vanes are made of metal and coated with ceramic material at the steps near said outlet port.

12. A turbomolecular pump according to claim 1, wherein both said rotor vanes and said stator vanes are made of metal and coated with ceramic material at the steps near said outlet port.

* * * * *